US005322467A

United States Patent [19]

Barzani

[11] Patent Number: 5,322,467

[45] Date of Patent: Jun. 21, 1994

[54] PLASTIC LINK TOY

[76] Inventor: Uri Barzani, 15 Mendes Street, Tel Hashomer, Ramat Gan, Israel

[21] Appl. No.: 935,195

[22] Filed: Aug. 26, 1992

Related U.S. Application Data

[63] Continuation-in-part of Ser. No. 803,610, Dec. 9, 1991, abandoned.

[30] Foreign Application Priority Data

Dec. 28, 1990 [IL] Israel ..... 096823

[51] Int. Cl.[5] ..... A63H 33/08

[52] U.S. Cl. ..... 446/125; 446/127

[58] Field of Search ..... 446/127, 125, 124, 121, 446/126, 104, 111, 112, 115, 116; D21/108

[56] References Cited

U.S. PATENT DOCUMENTS

| | | | |
|---|---|---|---|
| 6,356 | 3/1875 | Crandall | 446/102 X |
| 1,385,154 | 7/1921 | Shields | 446/125 |
| 2,674,827 | 4/1954 | Schaper | 446/126 X |
| 2,990,640 | 7/1961 | Burnbaum | 446/127 X |
| 3,139,698 | 7/1964 | Arnold | 446/124 |
| 3,192,738 | 7/1965 | Charles et al. | 446/121 X |
| 3,597,874 | 8/1971 | Ogsbury | 446/125 X |
| 4,874,341 | 10/1989 | Ziegler | 446/109 |
| 4,902,259 | 2/1990 | Ziegler | 446/125 X |

FOREIGN PATENT DOCUMENTS

| | | | |
|---|---|---|---|
| 0215727 | 3/1987 | European Pat. Off. . | |
| 3121758 | 12/1982 | Fed. Rep. of Germany | 446/125 |
| 2146809 | 3/1983 | Fed. Rep. of Germany . | |
| 3303367 | 10/1984 | Fed. Rep. of Germany . | |
| 8604253 | 7/1986 | Japan . | |

*Primary Examiner*—Mickey Yu

*Attorney, Agent, or Firm*—Wigman, Cohen, Leitner & Myers

[57] ABSTRACT

A plastic link toy including a plurality of geometrically shaped elements having a series of equally spaced slots formed by a series of equally spaced slots formed by a series of equally spaced roughened protrusions, having a thickness equal to the width of the slots. The elements are mounted onto a carrying element so that when two of the slotted elements are placed next to each other with the slots facing in the opposite direction, they can be linked to one another by having one set of protrusions penetrate the opposite slot cavities, and the linked elements can be swiveled around the axis formed by them. Other described modifications of the link toy enable the user to construct three-dimensional hinge connections.

4 Claims, 5 Drawing Sheets

PLASTIC LINK TOY

CROSS REFERENCE

This application is a continuation-in-part application to U.S. patent application No. 07/803,610 filed Dec. 9, 1991, abandoned.

BACKGROUND OF THE INVENTION

1. Field of the Invention

This invention relates to a plastic link to be used as a toy.

2. Description of the Prior Art

Several toys are known in the prior art linking together different types of geometric elements to form differently shaped objects. One such toy is the series of building blocks known as "Lego" toys. These comprise a series of building elements linked together by a specifically shaped protrusion on one element to be inserted into a similarly shaped cavity in the other element.

Other forms of linkage known in the prior art describe different attachment means between all kinds of shaped elements enabling children to form all sorts of imaginary multi linked shapes. None of these known toys enable children to both link the elements and simultaneously swivel them in the form of a hinge.

OBJECTS AND SUMMARY OF THE INVENTION

It is the purpose of this invention to provide a new kind of link element, made of rigid plastic, to be in any geometric shape, to enable children to link the elements and simultaneously swivel them on their axis in a similar manner as a hinge.

The plastic link toy herein provided comprises a plurality of geometrically shaped elements having a series of equally spaced slots, formed by a series of equally spaced protrusions mounted onto a solid base and having a thickness equal to the width of the slots; and said plurality of geometrically shaped slotted elements is mounted on a carrying means having said slotted elements face different directions; and said protrusions of said geometrically shaped slotted elements have roughened surfaces to prevent slippage of said elements from one another when linked;

so that when two of said slotted elements, mounted on different carrying means, are placed next to each other having the slots face in opposite directions, they can be linked to one another by having one set of protrusions penetrate the opposite slot cavities; and said linked elements can be swiveled around the axis, formed by them.

In one preferred embodiment said carrying means comprise a plurality of single connectors each connecting two of said slotted elements, facing different directions.

In another preferred embodiment said carrying means comprise a central carrying element, connected directly to said slotted elements.

In the further preferred embodiment said carrying means comprise a plurality of single connectors and a central carrying element; and each of said connectors is attached at one end to said slotted element, and at the other end to said central carrying element.

In the preferred embodiment said single connector is provided with longitudinal grooves, being a continuation of said slots of said slotted element, faced in the same direction, so as to enlarge the linkable surface of said toy.

In one preferred embodiment said geometrically shaped element is a sphere.

In a further preferred embodiment the number of protrusions of said slotted spherical element is seven.

In another preferred embodiment said geometrically shaped element is a prism having rounded off apexes.

In yet another preferred embodiment said geometric shape is a cube.

In another preferred embodiment said geometric element is a cylinder.

In the preferred embodiment said central carrying element is a ring, carrying said single connectors, provided with said sphere shaped elements.

In the preferred embodiment the number of said spherical slotted elements mounted on said ring carrier is six, so as to form hexagon-shaped link toy.

In the preferred embodiment the inner diameter of said ring carrier is equal to the outer diameter of said sphere shaped slotted elements; so that to allow a three-dimensional hinge-like link between said ring carrier and a separate said sphere shaped slotted element.

In another preferred embodiment said link toy has a shape of a longitudinal bar and comprises three of said spherical slotted elements connected by two of said single connectors.

In a further preferred embodiment said link toy has an H-shape and comprises seven of said sphere shaped elements, connected by six of said single connectors.

It is desired, that all the single connectors, used in all the different above mentioned link toys, have the same diameter and length. It is also desired that the length of the bar-shaped link toy, the length and the width of the H-shaped link toy, and the outer diameter of the hexagon-like link toy are the same; and the linked toys are provided with spherical slotted elements of the same size; so that the linked toys are modular and can be used in conjunction with each other.

In the preferred embodiment said single connector of any of said link toy can be inserted and secured between two adjacent single connectors of said hexagon-shaped link toy; so that the adjacent spherical slotted elements of said two linked toys engage and secure each other.

In a further preferred embodiment said central carrying element is a flat disc, having a diameter equal to the diameter of said spherical slotted elements; and a plurality of prism shaped slotted elements are mounted on the circumference of said disc; and said prism shaped slotted elements extend over the surface of said disc, so as to form a hinge-like three-dimensional element, enabling the user to insert and secure said sphere-shaped element into said hinge-like element and allowing its rotation into a desired position.

In one preferred embodiment said carrying disc is provided with a central orifice to reduce its weight.

In another preferred embodiment, in order to improve securing of said spherical element into said hinge-like element, said carrying disc is provided with a circumferential upright rib; and said rib being an integral part of said prism shaped slotted elements. In the preferred embodiment said prism shaped slotted elements are in form of longitudinal rectangular prisms having rounded off edges.

In one preferred embodiment each of said prism shaped slotted elements is provided with a rounded off filled ending; and a plurality of said filled endings form an inner flange on said hinge-like element in order to hold said spherical slotted element, when inserted.

In one preferred embodiment said prism shaped slotted elements extend over one of said disc's sides; and the second side of said disc is flat.

In a further embodiment said prism shaped slotted elements extend over one of said disc's sides; and the second side of said disc is provided with a rounded off body, being an integral part of said central carrying element.

In yet further embodiment said rounded off body is in the form of said spherical slotted element, mounted on said second side of said disc.

In another preferred embodiment said carrying disc is provided with a plurality of said prism-shaped slotted elements, which plurality is divided into two subpluralities; and said prism shaped elements of said first and second subpluralities extend correspondingly over the first and the second sides of said disc, so that to form on each side of said disc a three-dimensional hinge-like element, enabling the user to insert and secure said sphere-shaped slotted element, and allowing its rotation into any desired position.

In the preferred embodiment the number of said prism-shaped slotted elements mounted on said disc carrier is six.

In the preferred embodiment the number of said protrusions of said prism-shaped elements is three.

BRIEF DESCRIPTION OF THE DRAWINGS

The invention can be best described in the attached illustrations.

DETAILED DESCRIPTION OF THE PREFERRED EMBODIMENTS

Figure 1:
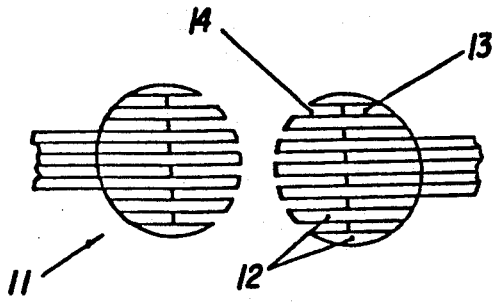
FIG. 1 illustrates a cross section of spherical elements with slots.
Figure 2:
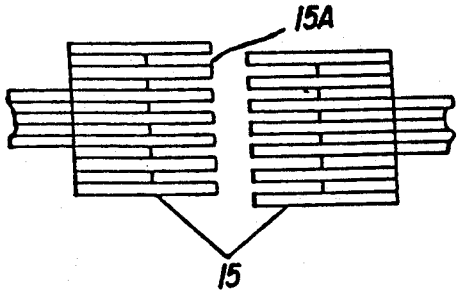
FIG. 2 illustrates a cross section of a cubical element.
Figure 3:
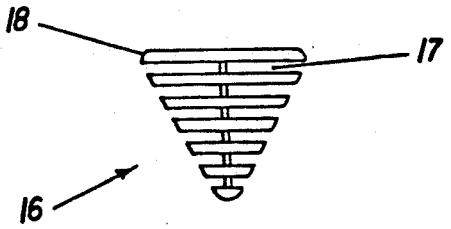
FIG. 3 illustrates triangle prism like elements.

FIGS. 1, 2, and 3 illustrate different shapes of slotted elements all having the same general features.

In FIG. 1 the spherical element 11 has a plurality of rigid plates 12, joined together by a solid half-circular section 13, forming slot cavities 14. The surface of the plastic in slots 14 are roughened to improve the linkage and reduce slippage of the plastic when two elements are joined together. When two such spheres 11 are linked by entering the plates 12 of one sphere into the cavities 14 of the opposite sphere, the two linked spheres can swivel around the axis formed by the linkage.

FIG. 2 illustrates cubical element 15 having basically the same structure.

FIG. 3 illustrates a prism 16 having slots 17 on the triangular front, and having child proof rounded off apexes 18.

Figure 4:
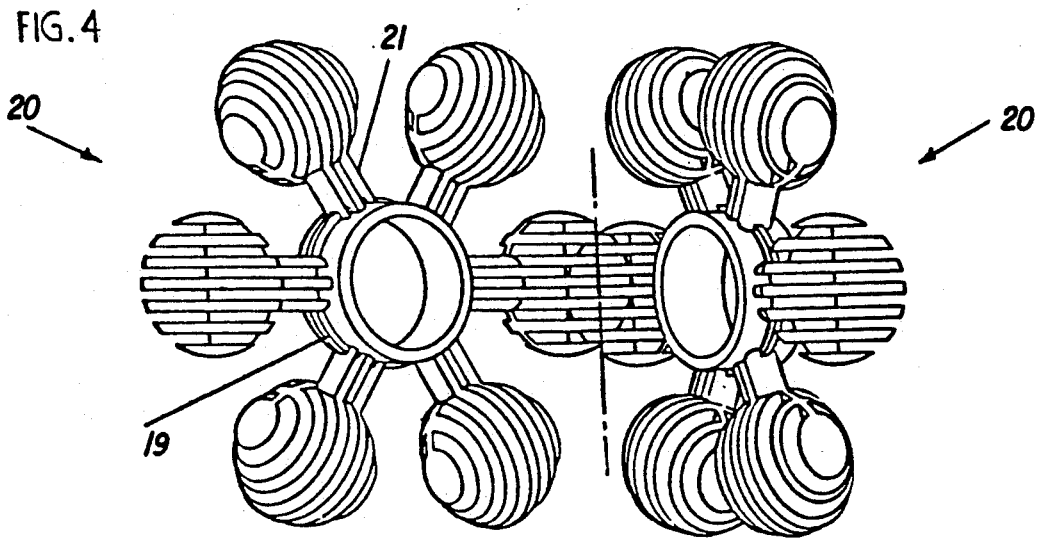
FIG. 4 illustrates a plurality of spherical elements mounted on a ring (hexagon-shaped toy), and two such toys linked to each other.

FIG. 4 illustrates six slotted spherical elements 11 mounted on a ring 19 by single connectors 21. Two such hexagon-like toys 20 are linked to each other, and the two linked elements swivel around the axis 21 formed by the link.

Figure 5:
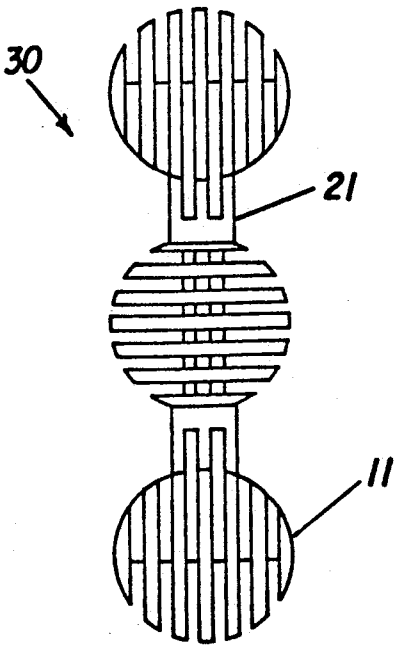
FIG. 5 illustrates a plurality of spherical elements connected by single connectors and forming a bar-like toy.

FIG. 5 illustrates a plurality of identical slotted spherical elements 11 mounted on carrying means, being a plurality of single connectors 21. In this particular construction, three slotted spherical elements 11, facing perpendicular directions, are connected by two single connectors 21 so as to form a bar-like toy 30. Such a bar-like toy 30 is intended to be used in conjunction with the hexagon-like toy 20. Any of the spherical slotted elements 11 of the bar 30 can be linked to any of the spherical slotted elements 11 of the hexagon 20, like it was shown in FIG. 4. The whole bar 30 can also be applied to the hexagon 20 along one of its outer diameters, so that both slotted elements 11, positioned at the bar's 30 endings, are linked to the corresponding slotted elements 11 of the hexagon 20. Some other possible arrangements will be shown later in FIG. 9.

Figure 6A:
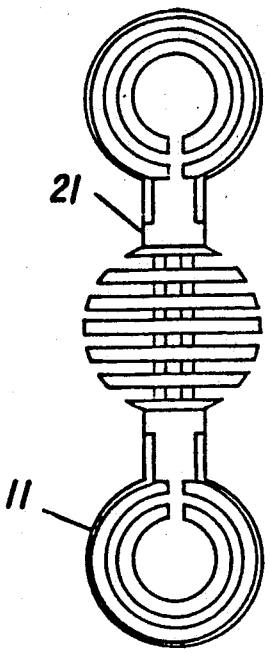
FIGS. 6,6A illustrate a plurality of spherical elements connected by single connectors and forming an H-like toy.
Figure 6:
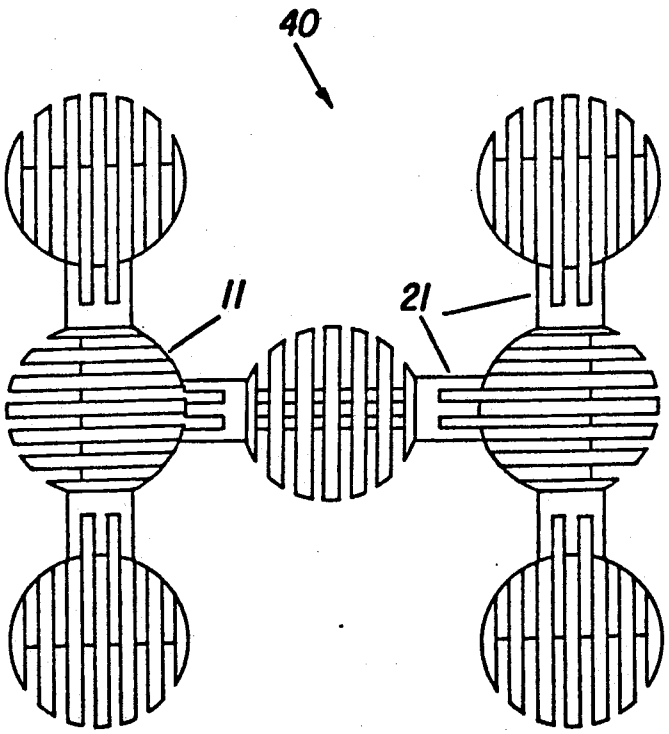

FIGS. 6, 6A illustrate a front view and a side view of another modification of the link toy, consisting of seven slotted spherical elements 11, and six single connectors 21, forming an H-like structure 40. The slots of the adjacent elements 11 face perpendicular directions. This H-like link toy 40 can be utilized in the game together with the toys 20 and 30 in the similar way as it is described in the previous paragraph.

Figure 7C:
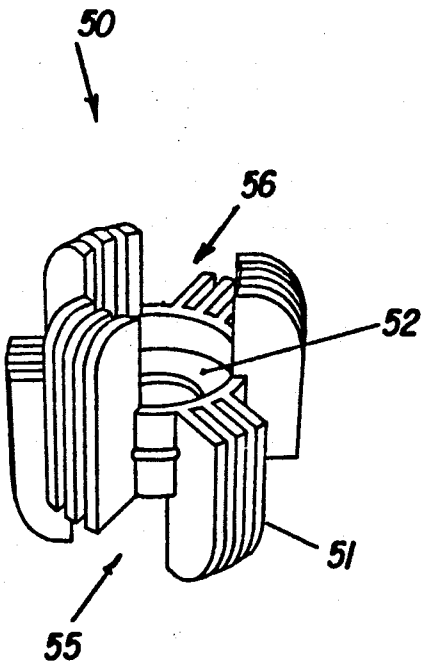
FIGS. 7A,B,C illustrate three views of a hinge-like symmetric element, formed by a plurality of rectangle prism-like slotted elements mounted on a circular central carrying element.
Figure 7B:
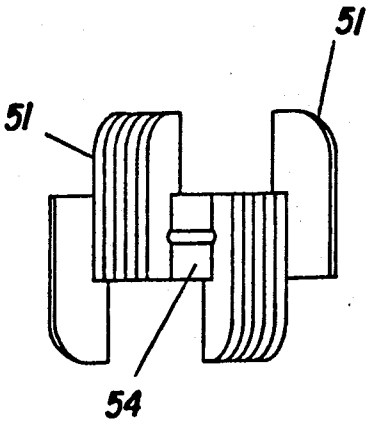
Figure 7A:
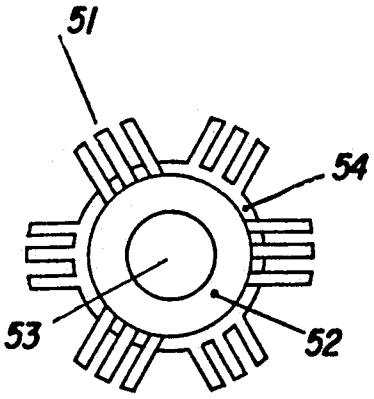

FIGS. 7 A,B,C illustrate three views of a hinge-like symmetric element 50, formed by six prism - like slotted elements 51 mounted on a circular carrier 52. The circular carrier 52 is in the form of a disc, provided with a central orifice 53 and a circumferential rib 54. The slotted elements 51 have the form of a longitudinal rectangular prism, and the apexes of these prisms are rounded off. This symmetric hinge-like element 50 comprises two spherical hinges 55 and 56, each formed by three slotted prism elements 51 and the disc 52.

Figure 8:
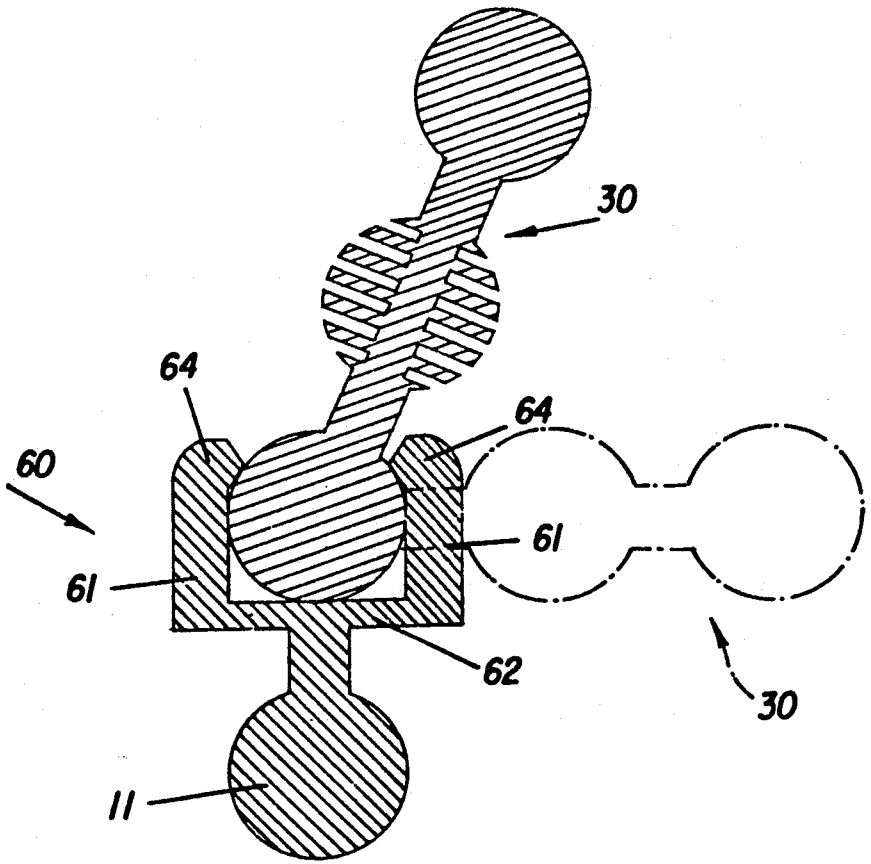
FIG. 8 illustrates another modification of the hinge-like element, showed in FIG. 7.

FIG. 8 is a cross section of another, non-symmetric modification 60 of the hinge-like element 50. The non symmetric hinge-like element 60 comprises one spherical hinge, formed on the upper side of a disc 62 by a plurality (say - four) of prismatic slotted elements 61. The slotted elements 61 are provided with filled endings 64 at their inner upper part, so as to hold between them an inserted spherical slotted element 11 of any described link toy (say, the bar-like toy 30). The lower part of the disc 62 is further connected to the spherical element 11 by the single connector 21.

One can use such hinge-like symmetric 50 or non-symmetric 60 elements in the game with any described link toy (see FIGS. 1,4,5,6) in order to create a compact ball-like connection. The elements 50 and 60 enable the user to rotate and turn any inserted link toy, forming a desired angle (0°–180°) between the axis of the inserted toy and the disc 52(62). The horizontal position of the inserted toy 30 is shown in FIG. 8 by the aid of a dotted contour; the single connector of the toy 30 is secured between two adjacent slotted elements 61. It is understood, that the toy illustrated in FIGS. 7, 8 also enables the user to link the prismatic slotted elements 51(61) to the spherical slotted elements 11 belonging to the other described modifications of the toy and continue building the construction in different directions.

Figure 9A:
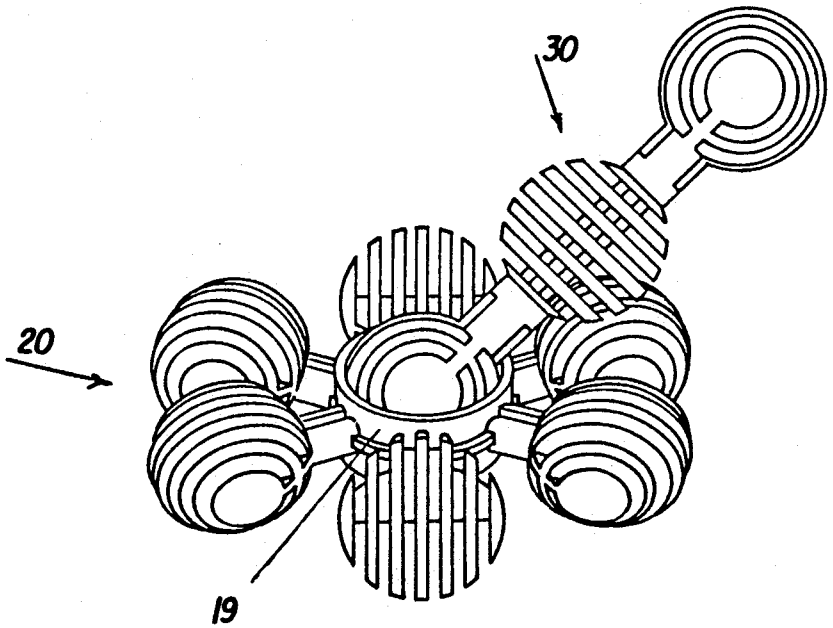
FIGS. 9A, 9B illustrate two possible links formed by two different link toys.

FIGS. 9A, B illustrate another two possible links between the described toys.

In FIG. 9A the ending spherical slotted element 11 of the bar-like toy 30 is inserted and secured in the inner space of the ring 19 of the hexagon-toy 20, where the toy 30 can be swivelled in three dimensions. The user thus creates different angles between the bar 30, and the hexagon's 20 surface, enabling him to build different constructions. It should be noted, that the user can substitute the bar-like toy 30 with the H-like toy 40, with another hexagon-like toy 20, or with the hinge-like toy 50, and form a similar link.

Figure 9B:
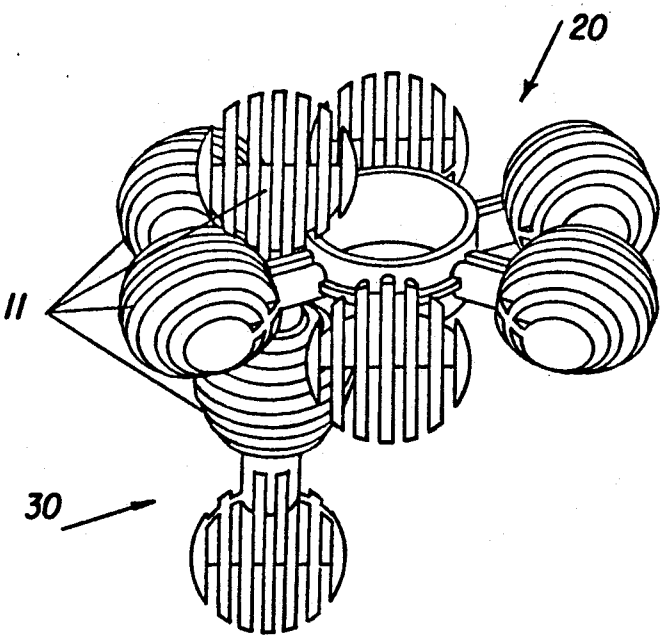

In FIG. 9B the single connector 21 of the bar-like link toy 30 (taken as an example) is inserted and secured between two adjacent single connectors 21 of the hexagon-shaped link toy 20. It can be seen, that the four adjacent spherical slotted elements 11 of these two linked toys engage and secure each other, forming a tight connection.

While the invention has been described in detail in reference to the attached drawings it should be appreciated that the invention could be executed in a large variety of shaped elements, mounted on a variety of carrying elements. In all of them the distinction is: the form of linkage between the elements; between the elements and the carrying means; and the ability to swivel around the axle formed by the linkage.

What is claimed is:

1. A plastic link toy comprising a plurality of geometrically shaped elements each having a series of equally spaced slots, formed by a series of equally spaced protrusions mounted onto a circular base and each portrusion having a thickness equal to the width of each slot; and said plurality of geometrically shaped slotted elements facing different directions; and said protrusions of said geometrically shaped slotted elements having roughened surfaces to prevent slippage of said elements from one another when linked; so that when two of said slotted elements, mounted on different bases are placed next to each other having the slots face in opposite directions, they can be linked to one another by having one set of protrusions penetrate the opposite slot cavities; and said linked elements can be swiveled around axis formed by them wherein said slotted elements are each in the form of a prism having rounded off apexes.

2. The plastic link toy as in claim 1, wherein said circular base is a ring, carrying six of said shaped elements so as to form a hexagon-shaped link toy.

3. The plastic link toy as in claim 1, wherein said prism shaped slotted elements extend over a side of said circular base.

4. The plastic link toy as in claim 1, wherein said circular base is provided with a plurality of said prism-shaped slotted elements, which plurality is divided into two subpluralities; and said prism-shaped elements of said first and second subpluralities extend correspondingly over a first side and a second side of said circular base, so that to form on each side of said circular base a hinge-like element when another shaped element is engaged therewith allowing its rotation into any desired position.

* * * * *